US007347699B2

(12) United States Patent
Sato et al.

(10) Patent No.: US 7,347,699 B2
(45) Date of Patent: Mar. 25, 2008

(54) SURFACE-MOUNTED ELECTRICAL CONNECTOR

(75) Inventors: Kensaku Sato, Tokyo (JP); Akira Shirai, Tokyo (JP); Yoshikazu Suzuki, Aichi-ken (JP); Hironao Hayashi, Gifu-ken (JP); Akira Ishimaru, Aichi-ken (JP); Tomokiyo Suzuki, Shizuoka-ken (JP); Osamu Kuriyagawa, Aichi-ken (JP); Iori Kobayashi, Aichi-ken (JP); Kensuke Nakanishi, Aichi-ken (JP)

(73) Assignees: Hirose Electric Co., Ltd., Rokyo (JP); Toyota Jidosha Kabushiki Kaisha, Aichi (JP)

( * ) Notice: Subject to any disclaimer, the term of this patent is extended or adjusted under 35 U.S.C. 154(b) by 21 days.

(21) Appl. No.: 11/448,781

(22) Filed: Jun. 8, 2006

(65) Prior Publication Data

US 2006/0279316 A1 Dec. 14, 2006

(30) Foreign Application Priority Data

Jun. 8, 2005 (JP) ..... 2005-168005

(51) Int. Cl.
*H01R 12/00* (2006.01)

(52) U.S. Cl. ..... 439/66; 439/908

(58) Field of Classification Search ..... 439/66, 439/74, 75, 80–82, 733.1, 908
See application file for complete search history.

(56) References Cited

U.S. PATENT DOCUMENTS

| | | | | |
|---|---|---|---|---|
| 4,528,500 | A * | 7/1985 | Lightbody et al. | 324/537 |
| 5,192,213 | A * | 3/1993 | Kosugi et al. | 439/66 |
| 5,362,241 | A * | 11/1994 | Matsuoka et al. | 439/66 |
| 6,196,866 | B1 * | 3/2001 | Gaschke | 439/482 |
| 6,932,620 | B2 * | 8/2005 | Ishiguro et al. | 439/66 |

FOREIGN PATENT DOCUMENTS

| | | | |
|---|---|---|---|
| JP | 7-221419 | | 8/1995 |
| WO | WO 92/08258 | * | 5/1992 |

OTHER PUBLICATIONS

European Search Report Oct. 19, 2006.

* cited by examiner

*Primary Examiner*—Tho D. Ta
(74) *Attorney, Agent, or Firm*—Kubotera & Associates, LLC

(57) ABSTRACT

A contactor (20) has a joint portion (27) which is jointed to each contactor pad (32) of one wiring board (30) by using a solder at one end portion thereof and a connecting portion (24) which is dip-soldered in each through hole (35) of the other wiring board (33) at the other end portion thereof. A housing (1) is constituted by integrally molding a housing main body (1F) having a U-like shape as seen from a plane and a reinforcing bar portion (2) which connects intermediate portions of opposed parts (1A) and (1B) of the housing main body (1F) with each other. Cavities (3) are substantially linearly formed in the housing main body (1F) at predetermined intervals. The contactors (20) are inserted into cavities (3), and the contactors (20) are movably held in the housing (1) with a holding member.

15 Claims, 14 Drawing Sheets

SURFACE-MOUNTED ELECTRICAL CONNECTOR

BACKGROUND OF THE INVENTION

1. Field of the Invention

The present invention relates to an electrical connector which connects two wiring boards with each other or a surface-mounted electrical connector which is mounted on a surface of a wiring board and used for connection or the like with respect to the other electrical connector.

2. Description of the Related Art

In general, an electrical connector is provided in an electrical circuit such as an ECU mounted in an automobile or the like in order to electrically connect one metal substrate (a wiring board) with the other printed board (a wiring board).

As a conventional surface-mounted electrical connector, there is one constituted of a plurality of contactors each having a joint portion which is jointed to a contactor pad of a wiring board through a solder and a housing which secures and holds these contactors in such a manner that the joint portions are substantially linearly aligned. For example, a gel type cream solder containing a solder component and a flux component is previously attached on each contactor pad of an aluminum substrate, and joint portions of many contactors of a surface-mounted electrical connector are pressed against and heated on respective contactor pads, thereby soldering the joint portions on the contactor pads.

It is to be noted that a regular hybrid integrated circuit mounted in a computer, an acoustic equipment, an automobile or the like has an aluminum substrate on which a semiconductor element or the like is mounted and a printed board which is hierarchized through a spacer which maintains a predetermined gap between the printed board and this aluminum substrate and on which a connector is mounted. Joint portions which are bent in an L-like shape at end portions of a plurality of leads are jointed on one lateral side of the aluminum substrate by using a solder, and many thin holes are provided in the printed board. The leads are inserted into and soldered in the thin holes, and connecting these leads with leads of the connector achieves connection between a semiconductor element or the like and the connector (see Patent Reference 1: Japanese Patent Application Laid-open No. 221419-1995).

As described above, in the conventional surface-mounted electrical connector, since many contactors are secured and held in the housing in such a manner that the respective joint portions are substantially linearly aligned, a flatness degree (within an allowable value of 0.1 mm) of the aluminum substrate becomes a problem when mounting this surfaced-mounted electrical connector on a surface of the aluminum substrate. When a degree of warpage or irregularities of the aluminum substrate is large, the joint portions are not seated on the contactor pads, and jointing between the contactor pads and the joint portions through a solder does not become normal, thereby leading to a problem of a joint defect.

In order to solve the above-described problems, it is an object of the present invention to provide a surface-mounted electrical connector which can prevent joint portions from being raised from contactor pads of a wiring board and avoid a joint defect.

SUMMARY OF THE INVENTION

To achieve this aim, according to the present invention, there is provided a surface-mounted electrical connector having: a plurality of contactors each having a joint portion which is jointed to each contactor pad of a wiring board through a solder; and a housing which holds these contactors, wherein the contactors can move with respect to the housing along an axial direction by a load larger than a holding force required for holding.

According to such a structure, even if warpage or irregularities are produced in the wiring board and a flatness degree is not smaller than an allowable value, and even if warpage is generated in the housing, pressing the joint portions against respective contactor pads can add to the contactors a load larger than a holding force required for holding the contactors, thereby moving the contactors to a predetermined position. Therefore, the joint portions are not raised from the respective contactor pads, and joint between the respective contactor pads and the joint portions can be normally carried out.

Further, a surface-mounted electrical contactor according to the present invention is, in the surface-mounted electrical connector of the present invention mentioned above, characterized in that a plurality of cavities are formed in the housing, and the contactors are inserted into these cavities, whereby these contactors are held by holding means.

According to such a configuration, applying to the contactors a load larger than a holding force produced by the holding means can move the contactors. Therefore, even if warpage or irregularities are produced in the wiring board and a flatness degree is not smaller than an allowable value, and even if warpage is generated in the housing, the joint portions can be pressed against the respective contactor pads, thereby moving the contactors to a predetermined position. Therefore, the joint portions are not raised from the contactor pads, and joint between the contactor pads and the joint portions through a solder can be normally carried out.

Furthermore, a surface-mounted electrical connector according to the present invention is, in the surface-mounted electrical connector of the present invention mentioned above, characterized in that the contactor has at one end portion thereof a joint portion which is jointed to a contactor pad of one wiring board through a solder and has at the other end portion thereof a connecting portion which is dip-soldered in a through hole of the other wiring board, the housing is configured by integrally molding a housing main body having a U-like shape as seen from a plane and a reinforcing bar portion which connects intermediate portions of opposed parts of the housing main body, many cavities are substantially linearly formed in the housing main body at predetermined intervals, the contactors are inserted into the cavities, and these contactors are held in the housing by holding means so as to be movable to a position corresponding to the contactor pads.

According to such a configuration, the contactors are inserted into the respective cavities arranged in a U-like form in a plane, these contactors are held in the housing with a predetermined holding force, and a load larger than a predetermined holding force is applied, whereby the joint portions are pressed against the contactor pads to move the contactors to a predetermined position. Moreover, the contactor pads are jointed to the joint portions through a solder, and the connecting portions of the contactors are inserted into and dip-soldered in through holes of the wiring board, thereby connecting one wiring board with the other wiring board.

Additionally, a surface-mounted electrical connector according to the present invention is, in the surface-mounted electrical connector of the invention mentioned above, characterized in that the joint portions are pressed against the contactor pads to apply to the contactors a load larger than a frictional force with respect to the housing, and the contactors are moved to a position corresponding to the contactor pads.

According to such a configuration, a load larger than a frictional force with respect to the housing is applied to the contactors by pressing the joint portions against the contactor pads, thereby moving the contactors to a predetermined position. Therefore, even if warpage or irregularities are produced in the wiring board and a flatness degree is not smaller than an allowable value, and even if warpage is generated in the housing, the joint portions can be pressed against the contactor pads to move the contactors to a predetermined position. Therefore, the joint portions are not raised from the contactor pads, and the contactor pads can be normally jointed to the joint portions through a solder.

Further, a surface-mounted electrical connector according to the present invention is, in the surface-mounted electrical connector of the present invention mentioned above, characterized in that the housing has a plurality of spacers which holds a predetermined gap between one and the other wiring boards.

According to such a configuration, the spacers can be used to set a predetermined gap between one and the other wiring boards, and electrical components or the like can be mounted on one or both of these wiring boards.

Furthermore, a surface-mounted electrical connector according to the present invention is, in the surface-mounted electrical connector of the present invention mentioned above, characterized in that the holding means is constituted by forming a spring piece portion in an inserting portion of each contactor which is inserted into each cavity, bringing the spring piece portion into contact with one inner wall portion of each cavity in a compressed state, and pressing the inserting portion against the other inner wall portion of the cavity by using a return force of the spring piece portion.

According to such a configuration, each contactor is held by a frictional force (a holding force) acting between the spring piece portion and the inner wall portion of the cavity and a frictional force (a holding force) acting between the inserting portion and the other inner wall portion of the cavity when the inserting portion is pressed against the other inner wall portion of the cavity by the return force of the spring piece portion, and applying a load larger than these frictional forces can move the contactor.

Therefore, even if warpage or irregularities are produced in the wiring board and a flatness degree is not smaller than an allowable value, and even if warpage is generated in the housing, the joint portions can be pressed against the contactor pads to move the contactors to a predetermined position. Accordingly, the joint portions are not raised from the contactor pads, and the contactor pads can be normally jointed to the joint portions through a solder.

Furthermore, a surface-mounted electrical connector according to the present invention is, in the surface-mounted electrical connector of the present invention mentioned above, characterized in that the holding means is constituted by forming a plurality of contact protruding portions on the inserting portion of the contactor which is inserted into the cavity, bringing these contact protruding portions into contact with the inner wall portion of the cavity and pressing the inserting portion against the other inner wall portion of the cavity.

According to such a configuration, the contactor can be held by a frictional force acting between the contact protruding portions and the inner wall portion of the cavity when the contact protruding portions are brought into contact with the inner wall portion of the cavity and the inserting portion is pressed against the other inner wall portion of the cavity and a frictional force (a holding force) acting between the inserting portion and the other inner wall portion of the cavity, and applying a load larger than these frictional forces can move the contactor to a predetermined position.

Therefore, even if warpage or irregularities are generated in the wiring board and a flatness degree is not smaller than an allowable value, and even if warpage is produced in the housing, each joint portion can be pressed against each contactor pad to move the contactor. Accordingly, each joint portion is not raised from each contactor pad, and the contactor pad can be normally jointed to the joint portion through a solder.

Moreover, a surface-mounted electrical connector according to the present invention is, in the surface-mounted electrical connector of the present invention mentioned above, characterized by comprising retaining means for preventing the contactor from falling off the cavity.

According to such a configuration, the retaining means can prevent the contactor from falling off the cavity.

Additionally, a surface-mounted electrical connector according to the present invention is, in the surface-mounted electrical connector of the present invention mentioned above, characterized in that the retaining means is constituted of one stopper portion which prevents the contactor from falling off in one direction of an axial line thereof, and the other stopper portion which prevents the contactor from falling off in the other direction of the axial line thereof.

According to such a structure, one and the other stopper portions can prevent the contactor from falling off the cavity.

According to the surface-mounted electrical connector of the present invention, even if warpage or irregularities are produced in the wiring board and a flatness degree is not smaller than an allowable value, and even if warpage is generated in the housing, a load larger than a holding force required for holding the contactors can be applied to the contactors by pressing the joint portions of the contactors against the contactor pads of the wiring board, thereby moving the contactors to a predetermined position. Therefore, the joint portions are not raised from the contactor pads, and the contactor pads can be normally jointed to the joint portions through a solder.

Further, according to the surface-mounted electrical connector of the present invention, the contactors are inserted into the respective cavities forming a substantially U-like arrangement in a plane, these contactors are held in the housing with a predetermined holding force, and a load larger than the predetermined holding force is applied to press the joint portions against the contactor pads, thereby moving the contactors to a predetermined position. The contactor pads are jointed to the joint portions through a solder, and the connecting portions of the contactors are inserted into and dip-soldered in the through holes of the other wiring board, thereby coupling one wiring board with the other wiring board.

Furthermore, according to the surface-mounted electrical connector of the present invention, a load larger than a frictional force with respect to the housing is applied to the contactors by pressing the joint portions against the contactor pads, whereby the contactors can be moved to a predetermined position. Therefore, even if warpage or irregularities are produced in the wiring board and a flatness degree is not smaller than an allowable value, and even if warpage is generated in the housing, the joint portions can be pressed against the contactor pads to move the contactors to a predetermined position. Thus, the joint portions are not raised from the contactor pads, and the contactor pads can be normally jointed to the joint portions by using a solder.

Moreover, according to the surface-mounted electrical connector of the present invention, the spacers can be used to set a space between one wiring board and the other wiring board to a predetermined gap, and electrical components can be mounted on one or both of these wiring boards.

Additionally, according to the surface-mounted electrical connector of the present invention, the contactors are held by using a frictional force (a holding force) acting between each spring piece portion and the inner wall portion of each cavity and a frictional force (a holding force) acting between each inserting portion and the other inner wall portion of each cavity when each inserting portion is pressed against the other inner wall portion of each cavity by a return force of the spring piece portion. Applying a load larger than these frictional forces can move the contactors to a predetermined position. Therefore, even if warpage or irregularities are produced in the wiring board and a flatness degree is not smaller than an allowable value, and even if warpage is generated in the housing, the contactors can be moved to press the joint portions against the contactor pads, thereby moving the contactors to a predetermined position. Therefore, the joint portions are not raised from the contactor pads, and the contactor pads can be normally jointed to the joint portions by using a solder.

Further, according to the surface-mounted electrical connector of the present invention, the contactors are held by using a frictional force acting between the contact protruding portions and the inner wall portion of each cavity when the contact protruding portions are brought into contact with the inner wall portion of each cavity and each inserting portion is pressed against the other inner wall portion of each cavity and a frictional force (a holding force) acting between each inserting portion and the inner wall portion of each cavity. Applying a load larger than these frictional forces can move the contactors to a predetermined position. Therefore, even if warpage or irregularities are produced in the wiring board and a flatness degree is not smaller than an allowable value, and even if warpage is generated in the housing, the joint portions can be pressed against the contactor pads, thereby moving the contactors to a predetermined position. Accordingly, the joint portions are not raised from the contactor pads, and the contactor pads can be normally jointed to the joint portions by using a solder.

Furthermore, according to the surface-mounted electrical connector of the present invention, the retaining means (one and the other stopper portions) can prevent each contactor from falling off each cavity.

DETAILED DESCRIPTION OF THE PREFERRED EMBODIMENTS

Embodiments of a surface-mounted electrical connector according to the present invention will now be described hereinafter with reference to the accompanying drawings.

Embodiment 1

FIGS. 1 to 7 show Embodiment 1 of a surface-mounted electrical connector according to the present invention.

Figure 1:
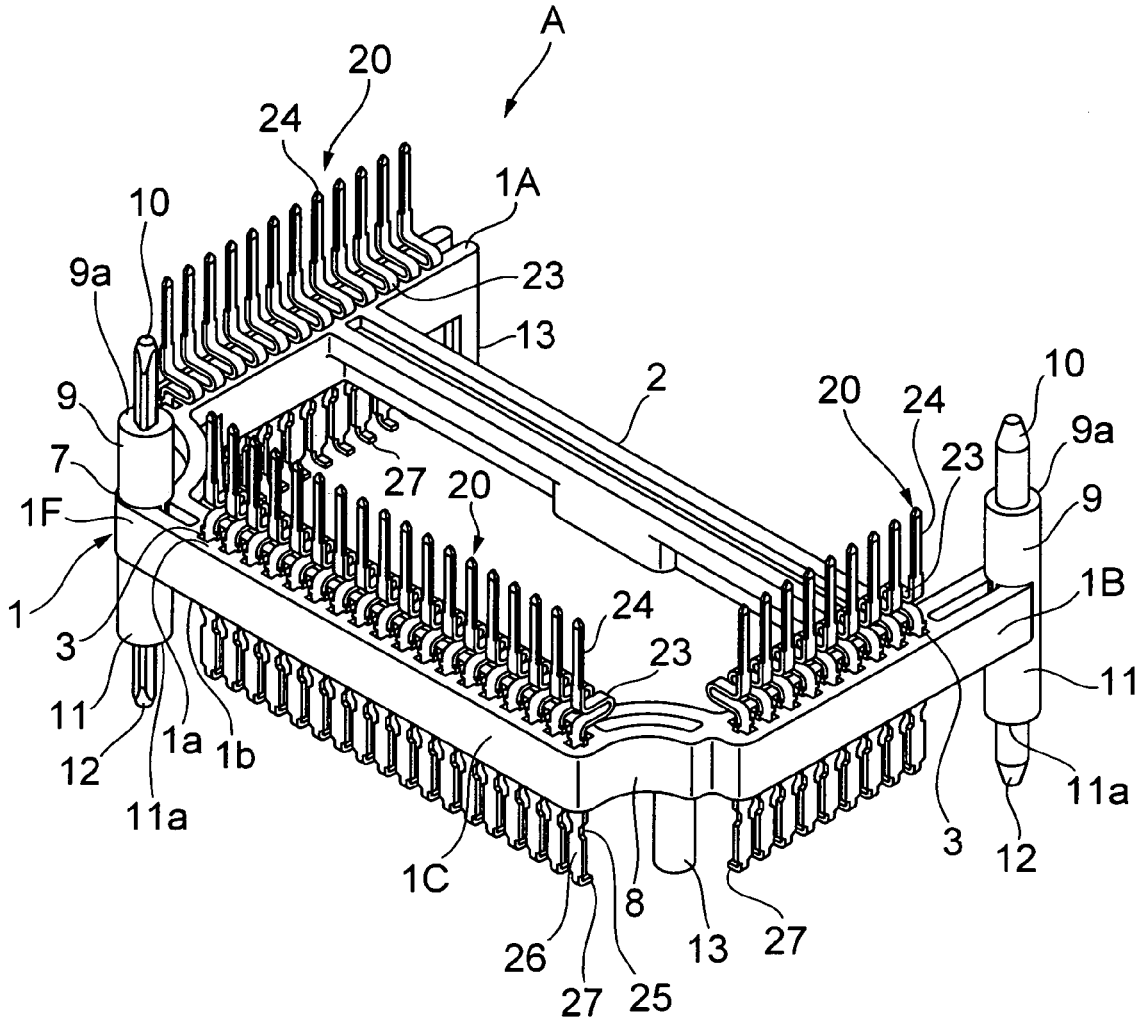
FIG. 1 is a perspective view showing Embodiment 1 of a surface-mounted electrical connector according to the present invention.
Figure 2:
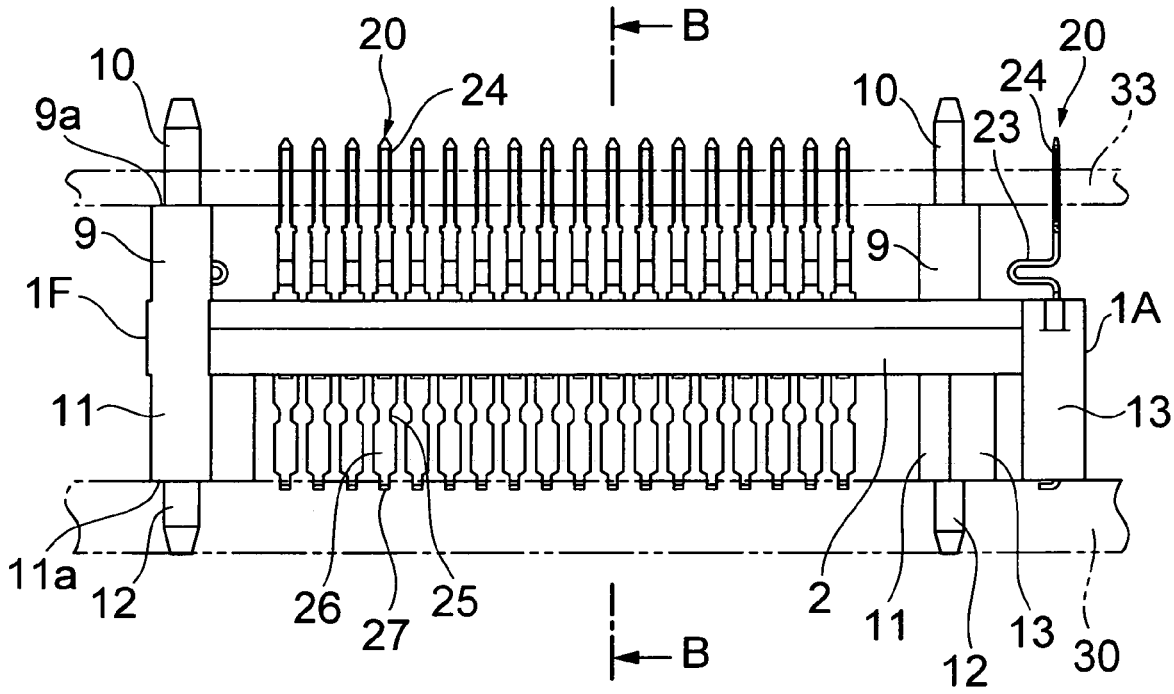
FIG. 2 is a front view showing the surface-mounted electrical connector.
Figure 3:
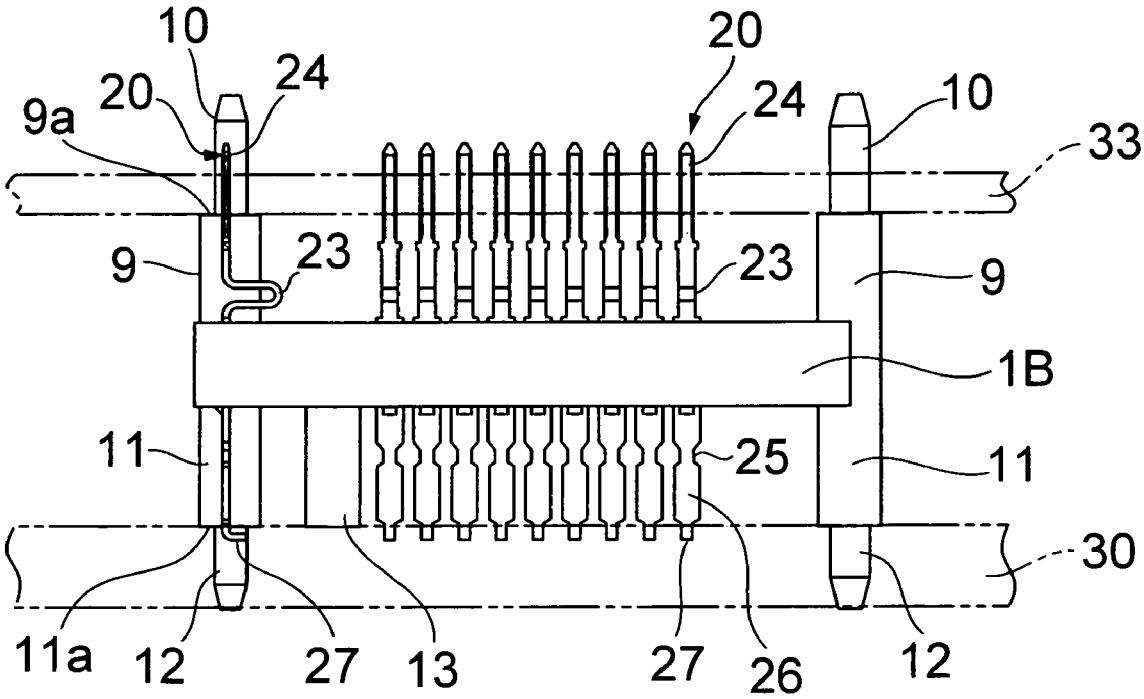
FIG. 3 is a side view showing the surface-mounted electrical connector.

FIG. 1 is a perspective view showing Embodiment 1 of a surface-mounted electrical connector according to the present invention, FIG. 2 is a front view showing the surface-mounted electrical connector, and FIG. 3 is a side view showing the surface-mounted electrical connector.

A surface-mounted electrical connector A according to the present invention is configured to include a housing 1 formed of a resin and many metal contactors 20.

The housing 1 is constituted by integrally molding a housing main body 1F which connects opposed linear parts 1A and 1B with each other through a linear part 1C at one end portion of each of these parts 1A and 1B, and a reinforcing bar portion 2 which connects intermediate portions of the parts 1A and 1B with each other.

Figure 6:
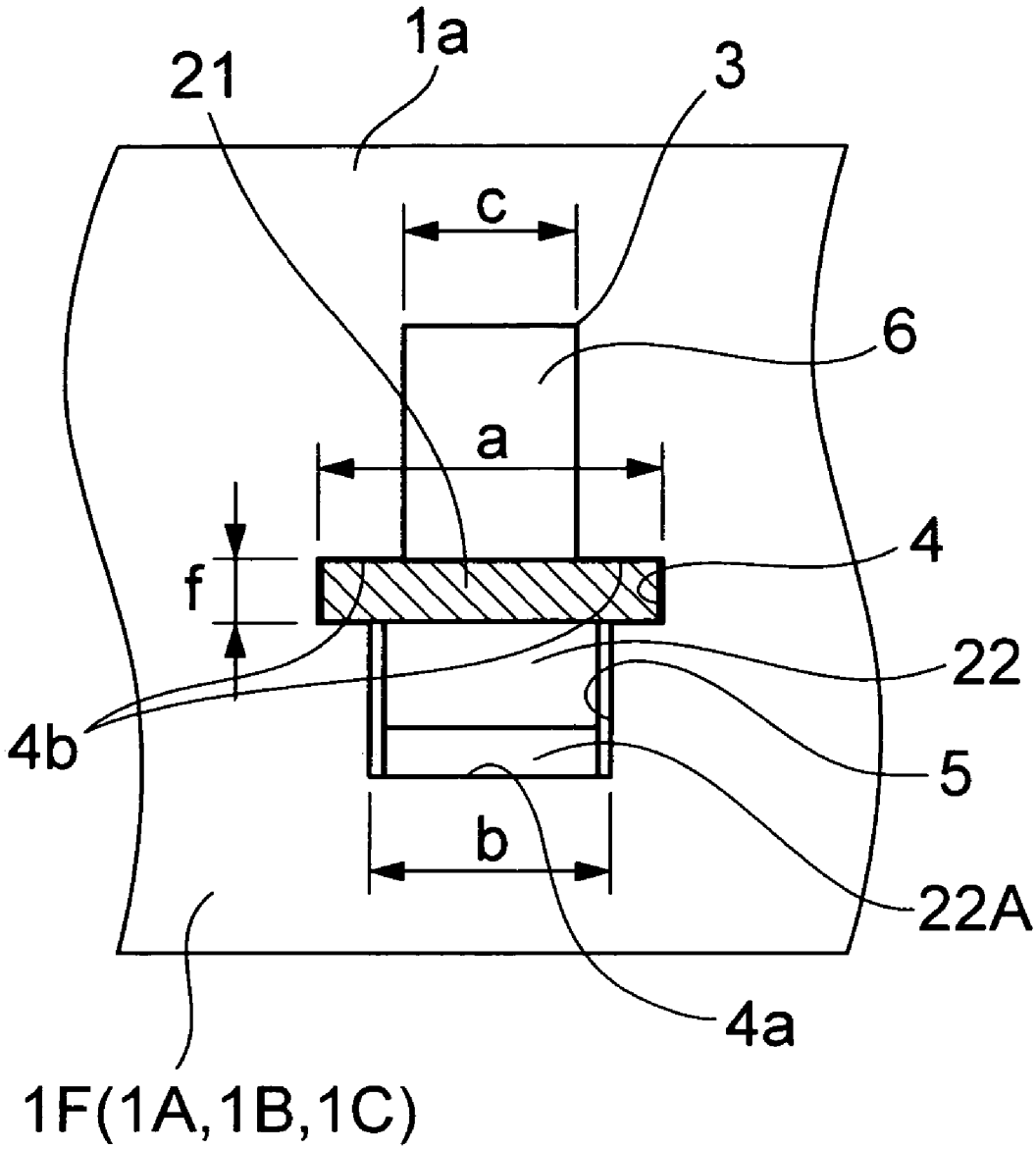
FIG. 6 is a cross-sectional view taken along a line D-D in FIG. 4.
Figure 7:
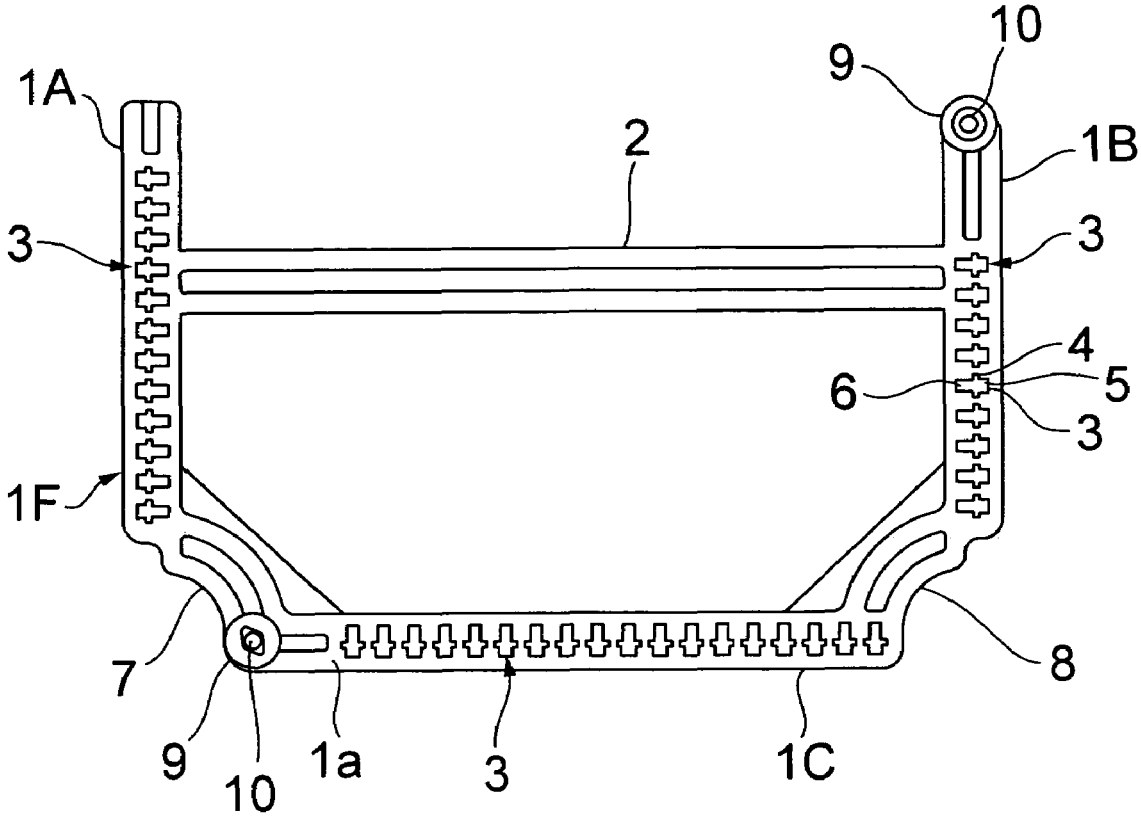
FIG. 7 is a plane view showing a housing in Embodiment 1 of the surface-mounted electrical connector according to the present invention.

Moreover, many cavities 3 are substantially linearly formed in the parts 1A, 1B and 1C at predetermined intervals. As shown in FIG. 1, these cavities 3 piece from a front surface (one surface) 1*a* of the parts 1A, 1B and 1C to a back surface (the other surface) 1*b* of the same. As shown in FIG. 6, the cavity 3 is constituted of a contactor inserting portion 4 having a rectangular plane which is positioned at a middle part, a spring inserting portion 5 having a rectangular plane which is positioned outside this contactor inserting portion 4 (a lower part in FIG. 6), and a hole portion 6 having a rectangular plane which is positioned in the contactor inserting portion 4 (an upper part in FIG. 6) and through which a joint portion 27 passes.

Additionally, as shown in FIG. 6, a width dimension a of the contactor inserting portion 4 is larger than a width dimension b of the spring inserting portion 5, and a width dimension c of the hole portion 6 is smaller than the width dimension b of the spring inserting portion 5.

Further, as shown in FIG. 1, spacers 9 are provided to protrude at a corner portion 7 formed by the part 1A and the part 1C and at the other end portion of the part 1B (a free end portion) on each front surface side (the same surface side as the front surface 1*a* of the parts 1A, 1B and 1C). These spacers 9 have the same height dimension. Furthermore, a positioning pin 10 protrudes from a top end portion 9*a* of each of these spacers 9.

Further, spacers 11 are provided to protrude at a corner portion 7 formed by the part 1A and the part 1C and at the other end portion (a free end portion) of the part 1B on each back surface side (the same surface side as the back surface 1*b* of the parts 1A, 1B and 1C). These spacers 11 have the same height dimension. Furthermore, a positioning pin 12 is provided to protrude at a top end portion 11*a* of each of these spacers 11. It is to be noted that an axial line of the spacer 9 matches with that of the spacer 11.

Moreover, spacers 13 are provided to protrude at a corner portion 8 formed by the part 1B and the part 1C and at the other end portion (a free end portion) of the part 1A on each rear surface side (the same surface side as the back surface 1*b* of the part 1A, 1B and 1C). These spacers 13 have the same height dimension as that of the spacer 11.

Figure 4:
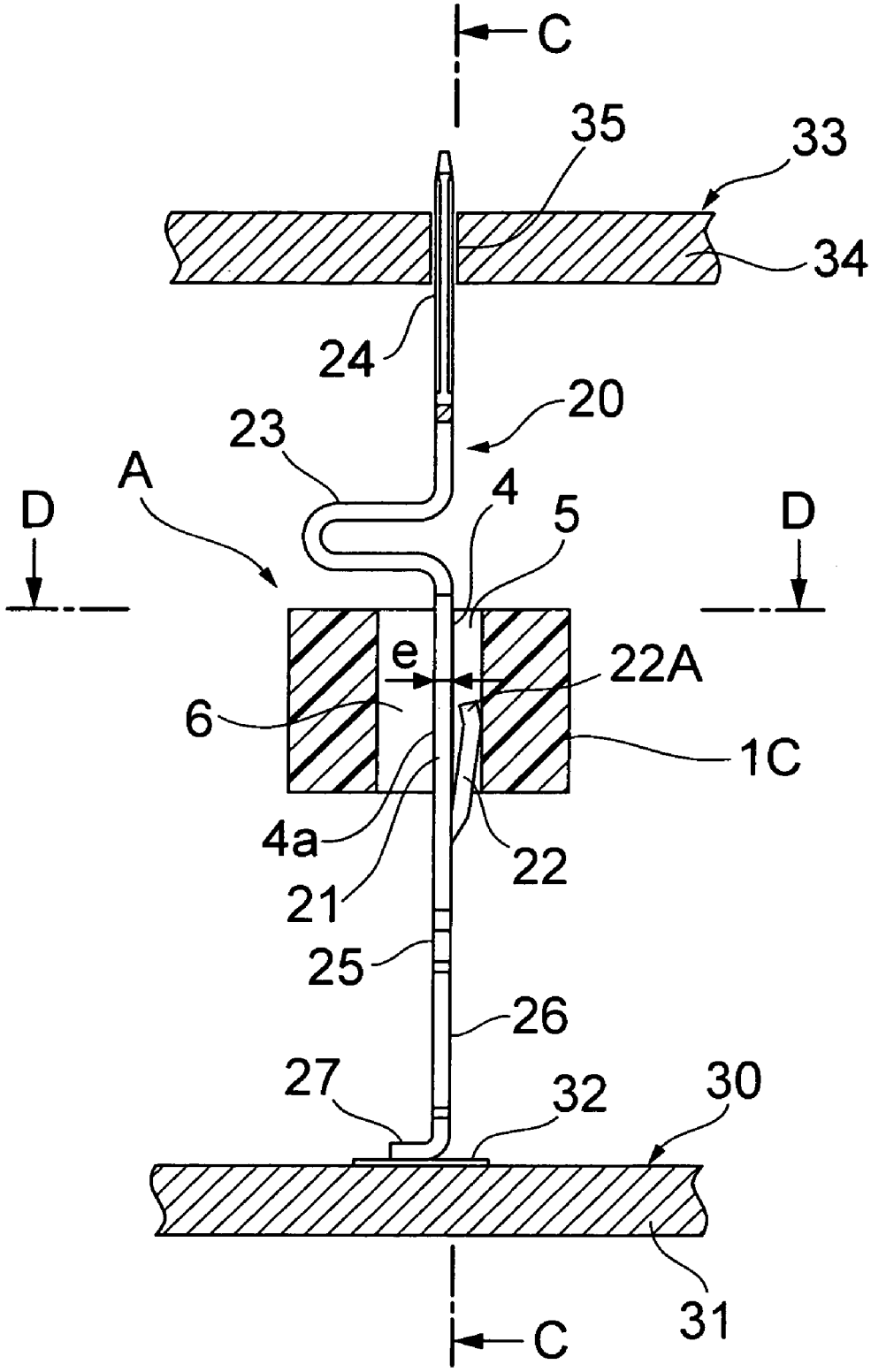
FIG. 4 is a cross-sectional view taken along a line B-B in FIG. 2.
Figure 5:
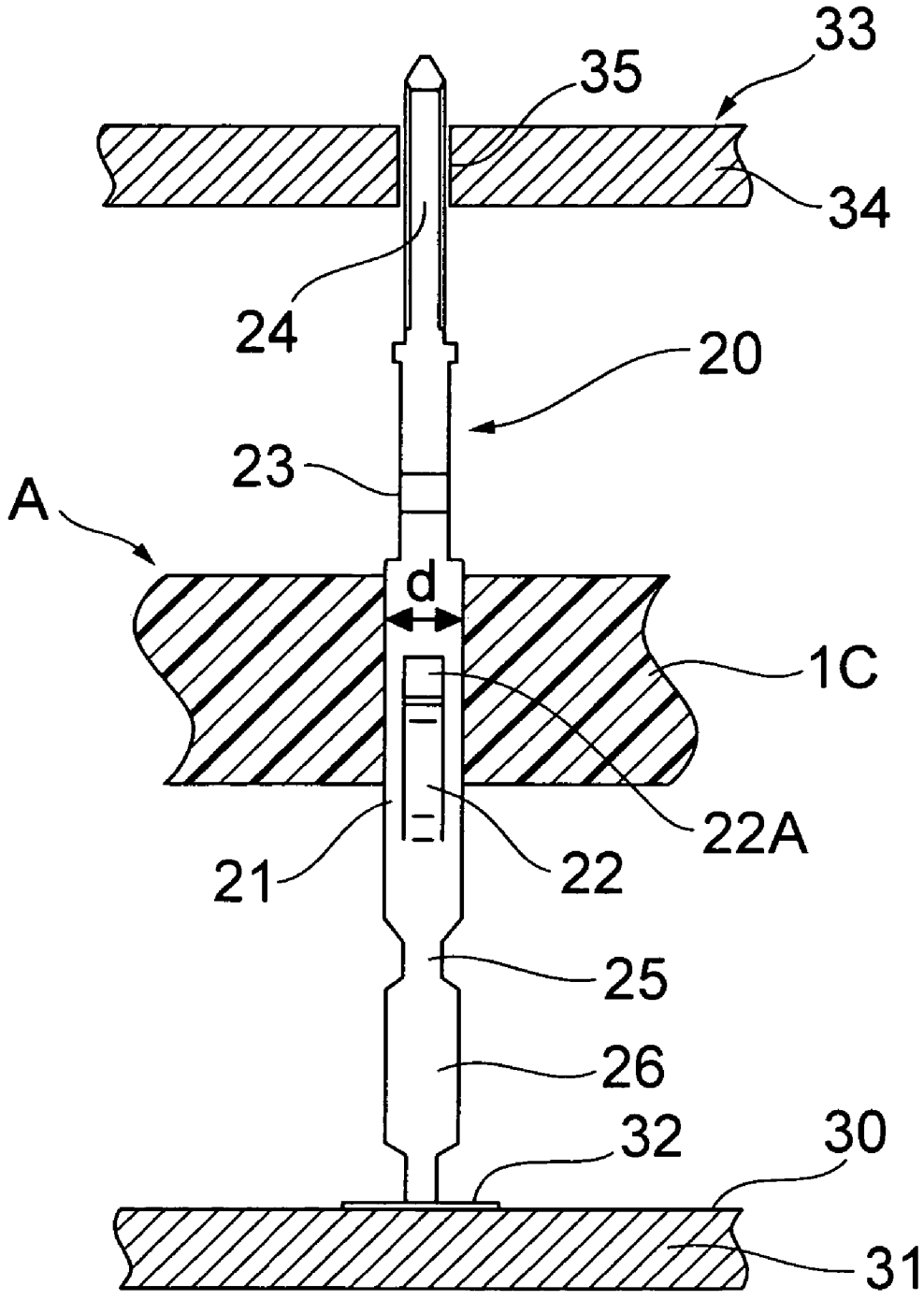
FIG. 5 is a cross-sectional view taken along a line C-C in FIG. 4.

As shown in FIGS. 4 and 5, a contactor 20 is provided with an inserting portion 21, a spring piece portion 22 formed of a cut-up part of this inserting portion 21, an impact absorbing portion 23 which is continuous with one end side (an upper end side in FIG. 4) of the inserting portion 21, a connecting portion 24 which is continuous with this impact absorbing portion 23, a thermal expansion absorbing portion 25 which is continuous with the other end side (a lower end side in FIG. 4) of the inserting portion 21, and a lead portion 26 which is continuous with this thermal expansion absorbing portion 25. An end part of the lead portion 26 is bent at a right angle to form a joint portion 27.

Additionally, a width dimension d of the inserting portion 21 is substantially the same as a width dimension a of a contactor inserting portion 4 of the cavity 3, and a thickness dimension e of the inserting portion 21 is substantially the same as a thickness dimension f of the contactor inserting portion 4 of the cavity 3 (see FIG. 6).

Further, a leading end of the spring piece portion 22 is bent to form a contact portion 22A which is substantially parallel with the inserting portion 21. Furthermore, the impact absorbing portion 23 is formed by bending a part which connects the inserting portion 21 with the connecting portion 24 into a U-like shape. Moreover, the thermal expansion absorbing portion 25 is formed by making a part which connects the inserting portion 21 with the lead portion 26 to be smaller than a width of the lead portion 26.

Additionally, as shown in FIGS. 4 to 6, the contactor 20 is attached in the cavity 3 by movably inserting the inserting portion 21 thereof into the contactor inserting portion 4 of the cavity 3. In this case, the spring piece portion 22 is inserted in a spring inserting portion 5 in a compressed state, and a return force of this spring piece portion 22 acts on the inserting portion 21, whereby this inserting portion 21 is appressed against an inner wall portion 4*b* of the contactor inserting portion 4 (see FIG. 6).

In this manner, the spring piece portion 22 is brought into contact with one inner wall portion 4*a* of the cavity 3 in the compressed state, and the return force of this spring piece portion 22 presses the inserting portion 21 against the other inner wall portion 4*b* of the cavity 3, thereby constituting holding means (see FIG. 6).

It is to be noted that the contactor 20 includes the spring piece portion 22, but the present invention is not restricted to this structure. The spring piece portion 22 may be provided on an inner side wall of the housing 1, and the holding means which holds a height position of the contactor within a predetermined load other than that of the spring piece portion 22 can suffice.

Therefore, each contactor 20 is held in the housing 1 by a frictional force acting between the spring piece portion 22 and one inner wall portion 4*a* and a frictional force acting between the inserting portion 21 and the other inner wall portion 4*b*, and applying a load larger than the frictional forces (holding forces) to the contactor 20 can move the contactor 20 in a direction of an axial line thereof (a vertical direction in FIGS. 4 and 5).

Further, one wiring board 30 is a surface-mounted wiring board having a structure in which a copper electroconductive path (not shown) constituted of a predetermined pattern is formed on a resin layer (not shown) on an aluminum substrate 31, and each contactor pad 32 corresponding to the joint portion 27 of each of many contactors 20 is formed on this wiring board 30. Furthermore, the other wiring board 33 is a wiring board adopting a through hole mount technology which has a structure in which a printed wiring line (not shown) is provided on an insulating substrate 34, and each through hole 35 corresponding to each of many connecting portion 24 of many contactors 20 is formed in the other wiring board 33.

Moreover, a gel type cream solder (not shown) containing a solder component and a flux component is previously attached on each contactor pad 32 of one wiring board 30, the positioning pins 12 of the spacers 11 of the surface-mounted electrical connector A are inserted into pin holes (not shown) of one wiring board 30, the positioning pins are pressed until the top end parts 11*a* of the spacers 11 come into contact with the wiring board 30, and the joint portions 27 of many contactors 20 are pressed against the respective contactor pads 32. Then, heating is carried out to solder the joint portions 27 on the contactor pads 32.

In this case, even if one wiring board 30 has warpage or irregularities and its flatness degree is not smaller than an allowable value, and even if warpage is generated in the housing 1, pressing the joint portions 27 against the respective contactor pads 32 can apply to the contactors 20 a load larger than a frictional force with respect to the housing 1, thereby moving the plurality of contactors 20 to a position corresponding to the contactor pads 32. Therefore, alignment can be performed in accordance with warpage or irregularities of the wiring board 30, the joint portions 27 are not raised from the contactor pads 32, and the contactor pads 32 can be normally jointed to the joint portions 27 through the solder. Solder joint may be carried out in the pressed state or after canceling the pressed state.

After the joint portions 27 of many contactors 20 of the surface-mounted electrical connector A are jointed to the contactor pads 32 of one wiring board 30 as described above, the positioning pins 10 of the spacers 9 of the surface-mounted electrical connector A are inserted into pin holes (not shown) of the other wiring board 33, and many connecting portions 24 are inserted into the through holes 35 of the other wiring board 32 until the top end parts 9*a* of the spacers 9 come into contact with the wiring board 32. Then, dip soldering is carried out, whereby one wiring board 30 is connected with the other wiring board 33 through the surface-mounted electrical connector A.

It is to be noted that, when an impact shock is applied to one wiring board 30 or the other wiring board 33, the impact absorbing portion 23 of the contactor 20 bends to absorb the impact shock, thereby preventing a crack from being generated in a solder fillet. Moreover, the thermal expansion absorbing portion 25 of the contactor 20 absorbs thermal expansion of the contactor 20 caused due to heating for soldering.

As described above, according to Embodiment 1 of the present invention, the holding means of the contactor 20 is constituted by forming the spring piece portion 22 on the inserting portion 21 which is inserted into the cavity 3 of the contactor 20 and bringing this spring piece portion 22 into contact with one inner wall portion 4*a* of the cavity 3 in the compressed state so that the return force of this spring piece portion 22 presses the inserting portion 21 against the other inner wall portion 4*b* of the cavity 3. The contactor 20 is held by the frictional forces acting between the spring piece portion 22 and one inner wall portion 4*a* of the cavity 3 and between the inserting portion 21 and the other inner wall portion 4*b* of the same, and applying a load larger than these holding forces can move this contactor 20.

Therefore, even if one wiring board 30 has warpage or irregularities and its flatness degree is not smaller than an allowable value, and even if warpage is generated in the housing 1, a load larger than the frictional forces can be applied to the contactor 20 by pressing the joint portion 27 against each contactor pad 32, thereby moving the plurality of contactors 20 to a position corresponding to the contactor pads 32. Therefore, alignment can be effected in accordance with warpage or irregularities of the wiring board 30, each joint portion 27 is not raised from each contactor pad 32, and the contactor pad 32 can be normally jointed to the joint portion 27 by using a solder.

Furthermore, according to Embodiment 1 of the present invention, the contactors 20 are inserted into the respective cavities 3 arranged in a U-like shape in a plane, these contactors 20 are held in the housing 1 with a predetermined holding force, and a load larger than the predetermined holding force is applied. As a result, the contactors 20 are moved to press the joint portions 27 against the contactor pads 32, and the contactor pads 32 are jointed to the joint portions 27 by using a solder, and the connecting portions 24 of the contactors 20 are inserted into the through holes 35 of the other wiring board 33 to perform dip soldering, thereby connecting one wiring board 30 with the other wiring board 33. Moreover, since the contactors 20 are held in the housing 1 with a predetermined holding force, a load and an electrical resistance can be fixed at a low cost.

Additionally, according to Embodiment 1 of the present invention, the spacers 9, 11 and 13 can set a predetermined gap between one wiring board 30 and the other wiring board 33, and electronic components can be mounted on one or both of these wiring boards 30 and 33.

Figure 8:
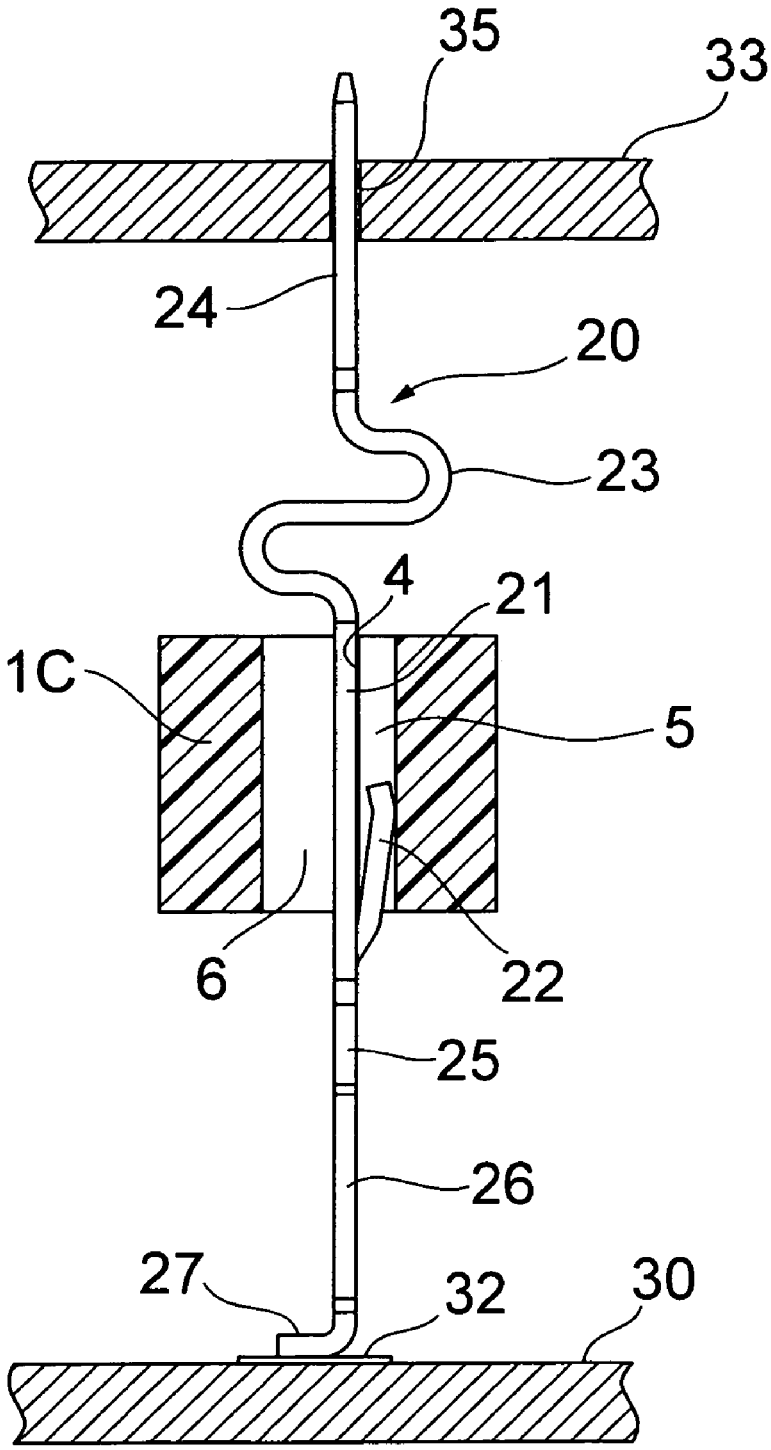
FIG. 8 is an explanatory view showing a coupling state of one and the other wiring boards achieved by a surface-mounted electrical connector using contactors each having a substantially-S-shaped impact absorbing portion.

It is to be noted that, as the contactor 20, it is possible to use one having the impact absorbing portion 23 formed by bending the part connecting the inserting portion 21 with the connecting portion 24 into a substantially-S-like shape as shown in FIG. 8.

Embodiment 2

Figure 9:
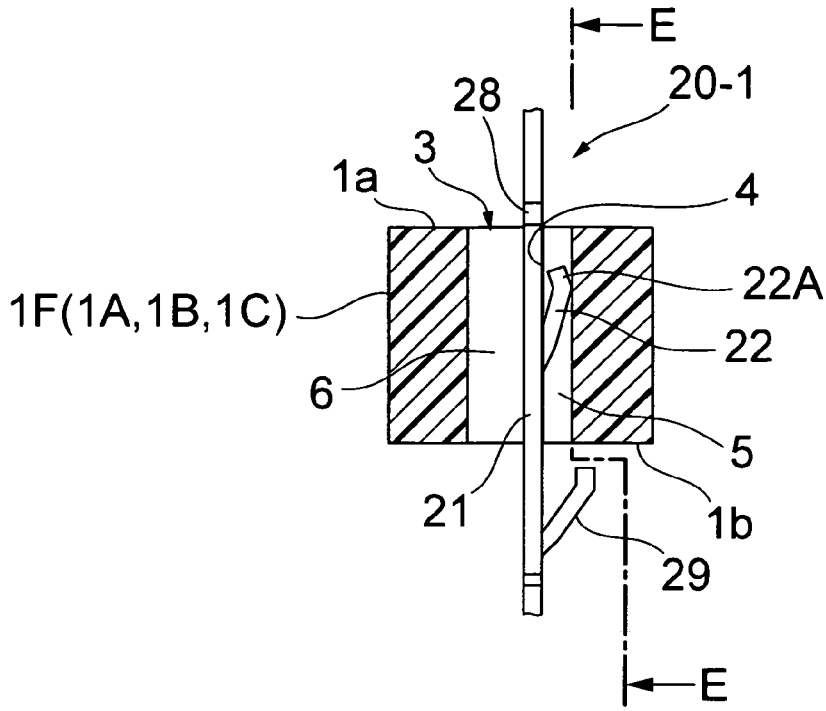
FIG. 9 is an explanatory view showing holding means for each contactor in Embodiment 2 of a surface-mounted electrical connector according to the present invention.
Figure 10:
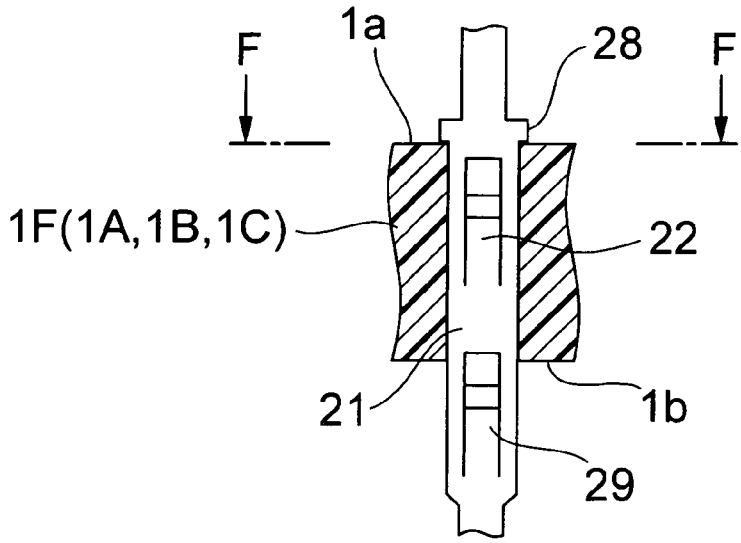
FIG. 10 is a cross-sectional view taken along a line E-E in FIG. 9.
Figure 11:
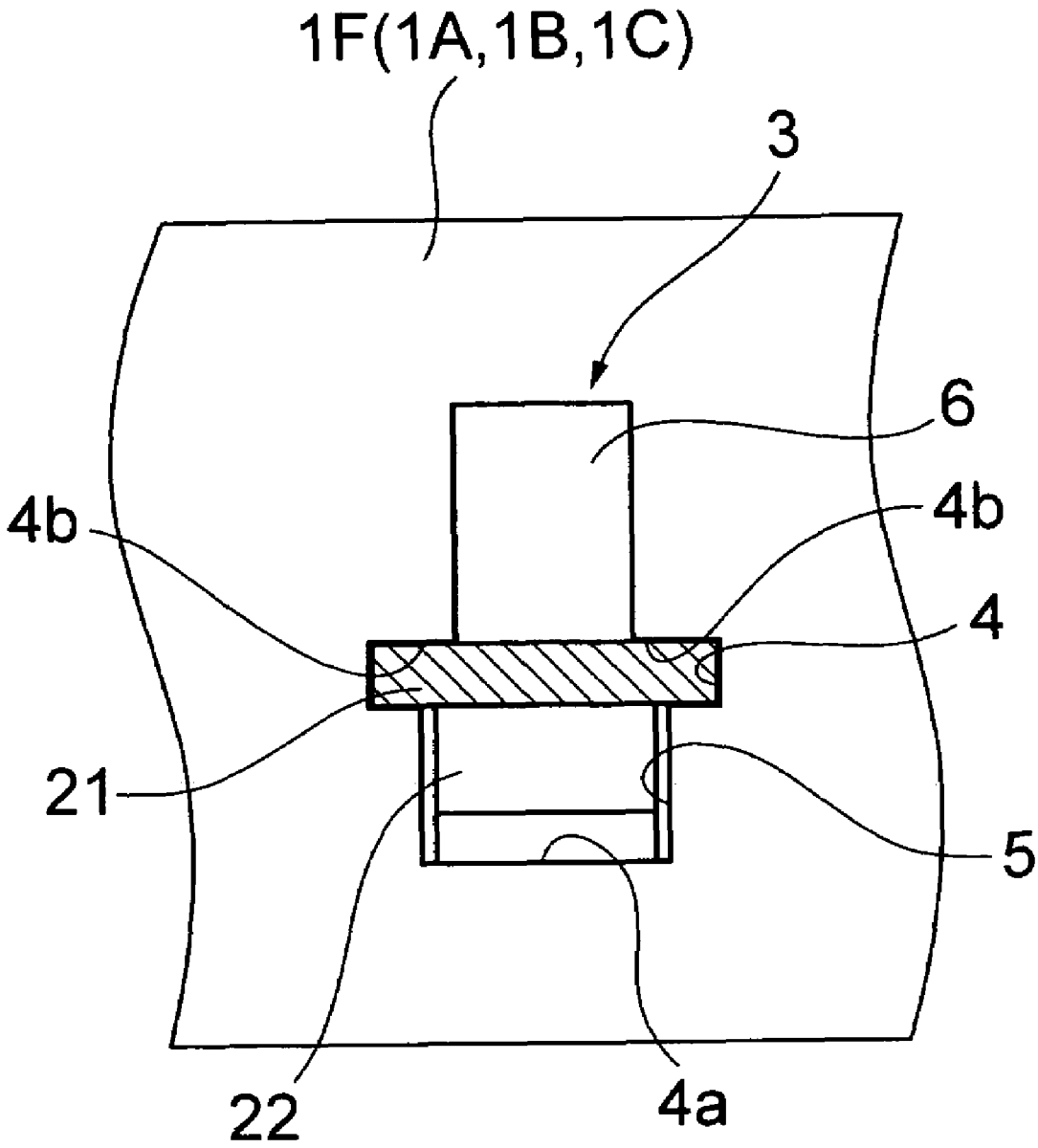
FIG. 11 is a cross-sectional view taken along a line F-F in FIG. 10.

FIGS. 9 to 11 show Embodiment 2 according to the present invention.

A difference of Embodiment 2 according to the present invention from Embodiment 1 of the present invention is a contactor alone, and other structures are the same as those in Embodiment 1 of the present invention. Therefore, like reference numerals denote like parts, thereby eliminating their explanation.

A contactor 20-1 in Embodiment 2 according to the present invention has one stopper portion 28 formed on an impact absorbing portion 23 side of an inserting portion 21 thereof, and the other piece-like stopper portion 29 formed of a cut-up part on a thermal expansion absorbing portion 25 side which is the same side as a spring piece portion 22 of the inserting portion 21. Other structures are the same as those of the contactor 20 in Embodiment 1 according to the present invention.

Additionally, the contactor 20-1 is attached in a cavity 3 by movably inserting its inserting portion 21 into a contactor inserting portion 4 of the cavity 3. In this case, the spring piece portion 22 is inserted in a spring inserting portion 5 in a compressed state, a return force of this spring piece portion 22 acts on the inserting portion 21 to press this inserting portion 21 against an inner wall portion 4*b* of the contactor inserting portion 4, and the contactor 20 is held in a housing 1 by a frictional force acting between the spring piece portion 22 and one inner wall portion 4*a* and a frictional force (a holding force) acting between the inserting portion 21 and the other inner wall portion 4*b*.

In this manner, the spring piece portion 22 is brought into contact with one inner wall portion 4*a* of the contactor inserting portion 4 in the compressed state, and the return force of this spring piece portion 22 presses the inserting portion 21 against the other inner wall portion 4*b* of the contactor inserting portion 4, thereby constituting holding means.

Further, one stopper portion 28 is in close proximity to a front surface 1*a* of the housing 1, the other stopper portion 29 is positioned outside the spring inserting portion 5, and an end part of this stopper portion 29 is in close proximity to a back surface 1*b* of the housing 1. Therefore, a moving range of the contactor 20-1 corresponds to a sum of a gap between one stopper portion 28 and the front surface 1*a* of the housing 1 (zero in case of FIGS. 9 and 10) and a gap between the end part of the other stopper portion 29 and the back surface 1*b* of the housing 1.

As described above, the contactor 20 is held in the housing 1 by the frictional forces (holding forces) acting between the spring piece portion 22 and one inner wall portion 4*a* and between the inserting portion 21 and the other inner wall portion 4*b*, and applying a load larger than the frictional forces to the contactor 20-1 can move the contactor 20-1 within its moving range.

Therefore, a gel type cream solder (not shown) containing a solder component and a flux component is previously attached on each contactor pad 32 of one wiring board 30, and joint portions 27 of many contactors 20 are pressed against the respective contactor pads 32. Then, heating is carried out, thereby soldering the joint portions 27 to the contactor pads 32. Incidentally, when the contactor 20-1 is greatly moved, one stopper portion 28 collides with the front surface 1*a* of the housing 1, and the end part of the other stopper portion 29 collides with the back surface 1*b* of the housing 1, thereby preventing the contactor 20-1 from falling off.

As described above, according to Embodiment 2 of the present invention, even if one wiring board 30 has warpage or irregularities and its flatness degree is not smaller than an allowable value, and even if warpage is generated in the housing 1, a load larger than the frictional force with respect to the housing 1 can be applied to the contactors 20-1 by pressing the joint portions 27 against the respective contactor pads 32, thus moving the contactors 20-1 to a position corresponding to the contactor pads 32. Therefore, alignment can be carried out in accordance with warpage or irregularities of the wiring board 30, the joint portions 27 are not raised from the contactor pads 32, and the contactor pads 32 can be normally jointed to the joint portions 27 by using a solder.

Embodiment 3

Figure 12:
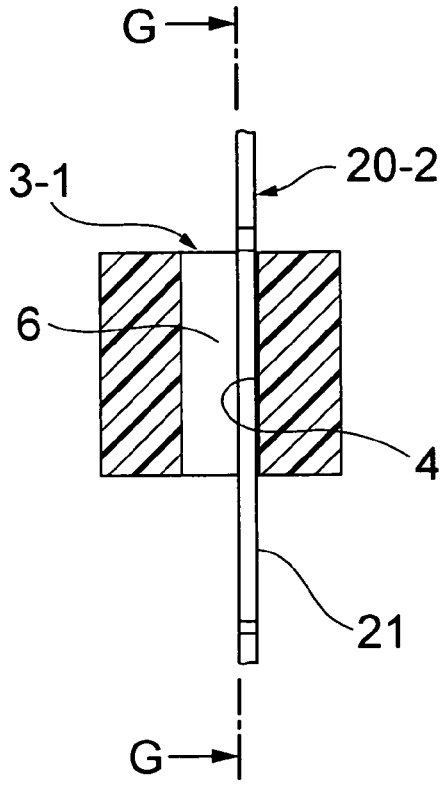
FIG. 12 is an explanatory view showing holding means for each contactor in Embodiment 3 of a surface-mounted electrical connector according to the present invention.
Figure 13:
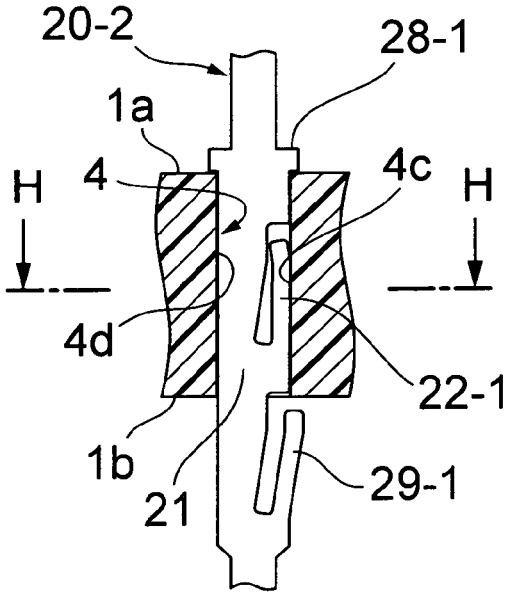
FIG. 13 is a cross-sectional view taken along a line G-G in FIG. 12.
Figure 14:
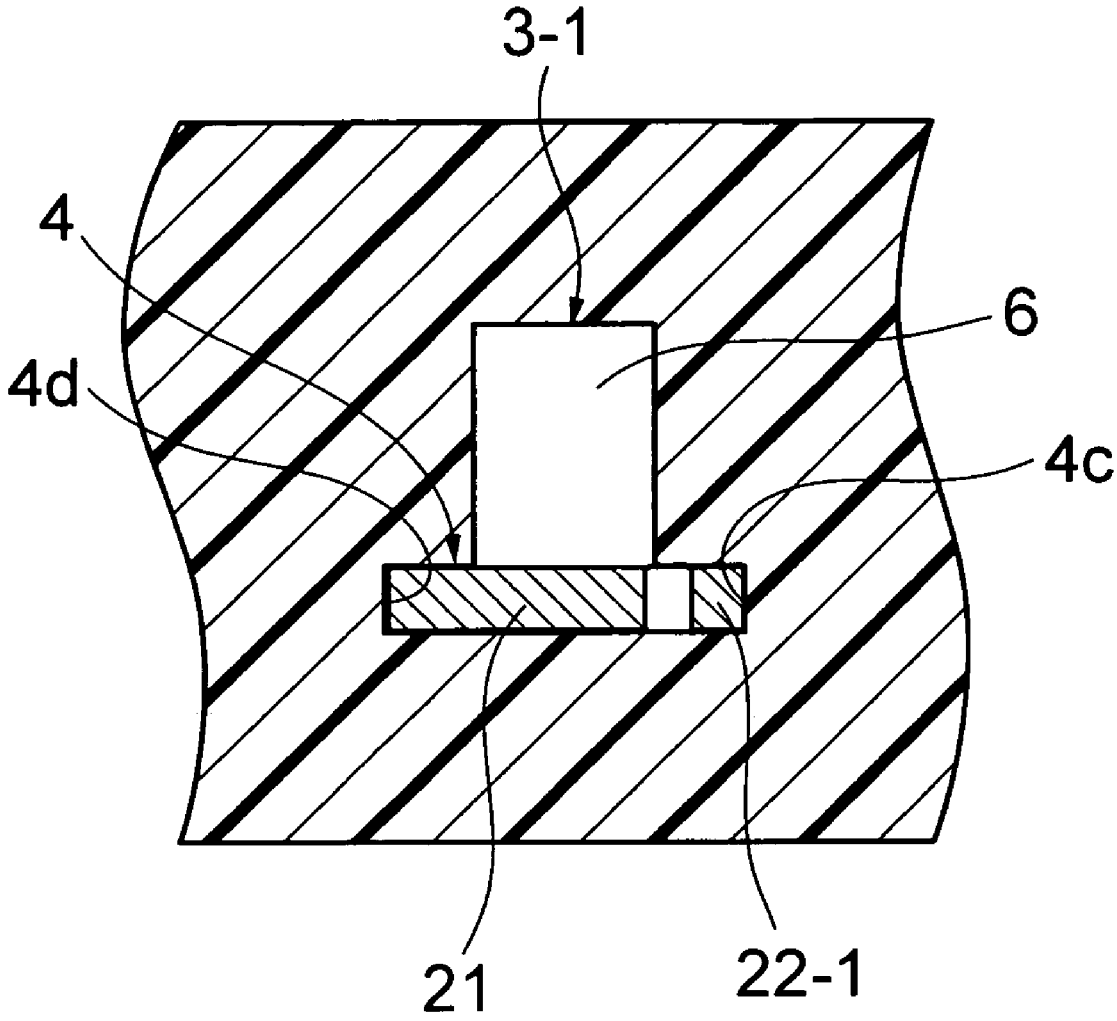
FIG. 14 is a cross-sectional view taken along a line H-H in FIG. 13.

FIGS. 12 to 14 show Embodiment 3 according to the present invention.

A difference of Embodiment 3 according to the present invention from Embodiment 1 of the present invention lies in a shape of a cavity and a contactor inserted into this cavity, and other structures are the same as those in Embodiment 1 according to the present invention. Therefore, like reference numerals denote like parts, thereby eliminating their explanation.

As shown in FIG. 14, a cavity 3-1 in Embodiment 3 according to the present invention is constituted of a contactor inserting portion 4 which is positioned in a middle part and has a rectangular shape as seen from a plane, and a hole portion 6 which is positioned in the contactor inserting portion 4 (an upper side in FIG. 14) and through which a joint portion 27 passes and which has a rectangular shape as seen from a plane.

In a contactor 20-2 in Embodiment 3 according to the present invention, its spring piece portion 22-1 is formed of a cut-up part at one side part of an inserting portion 21 in such a manner that it protrudes toward a lateral side. Further, one stopper portion 28-1 is formed on an impact absorbing portion 23 side of the inserting portion 21, and the other piece-like stopper portion 29-1 is formed of a cut-up part on one side part of the inserting portion 21 in such a manner that it protrudes toward a lateral side. Furthermore, other structures are the same as those of the contactor 20 in Embodiment 1 according to the present invention.

Moreover, as shown in FIGS. 12 and 13, each contactor 20-2 is attached in a housing 1 by movably inserting its inserting portion 21 into a contactor inserting portion 4 of each cavity 3. In this case, the spring piece portion 22-1 is inserted in the contactor inserting portion 4 in a compressed state, this spring piece portion 22-1 is compressed and deformed on the inserting portion 21 side, its end part comes into contact with one side surface portion 4*c* as an inner wall portion of the contactor inserting portion 4, and a return force of the spring piece portion 22-1 acts on the inserting portion 21 to press this inserting portion 21 against the other side wall portion 4*d* which is the inner wall portion of the contactor inserting portion 4. Therefore, the contactor 20-2 is held in the housing 1 by a frictional force acting between the spring piece portion 22-1 and one side wall portion 4*c* and a frictional force (a holding force) acting between the inserting portion 21 and the other side surface portion 4*d* of the contactor inserting portion 4.

The spring piece portion 22-1 is brought into contact with the other side surface portion 4*c* which is the inner wall portion of the contactor inserting portion 4 in the compressed state in this manner, and the return force of this spring piece portion 22-1 thereby presses the inserting portion 21 against the other side surface portion 4*d* which is the inner wall portion of the contactor inserting portion 4, thus constituting holding means.

Additionally, one stopper portion 28-1 is in close proximity to a front surface 1*a* of the housing 1, the other stopper portion 29-1 is positioned outside the contactor inserting portion 4, and the end part of this stopper portion 29-1 is in close proximity to a back surface 1*b* of the housing 1. Therefore, a moving range of the contactor 20-2 is a sum of a gap between the stopper portion 28-1 and the front surface 1*a* of the housing 1 (zero in case of FIGS. 12 and 13) and a gap between the end part of the stopper portion 29-1 and the back surface 1*b* of the housing 1.

As described above, the contactor 20-2 is held in the housing 1 by the frictional forces acting between the spring piece portion 22-1 and one side surface portion 4*c* of the contactor inserting portion 4 and between the inserting portion 21 and the other side surface portion 4*d* of the same, and applying to the contactor 20-2 a load larger than the frictional force with respect to the housing 1 can move the contactor 20-2 within its moving range.

Therefore, a gel type cream solder (not shown) containing a solder component and a flux component is previously attached on each contactor pad 32 of one wiring board 30, and joint portions 27 of many contactors 20 are pressed against the respective contactor pads 32. Then, heating is carried out, thereby soldering the joint portions 27 to the contactor pads 32. It is to be noted that, when the contactor 20-2 is greatly moved, one stopper portion 28-1 collides with the front surface 1*a* of the housing 1, and the end part of the other stopper portion 29-1 collides with the back surface 1*b* of the housing 1, thereby preventing the contactor 20-2 from falling off.

As described above, according to Embodiment 3 of the present invention, even if one wiring board 30 has warpage or irregularities and its flatness degree is not smaller than an allowable value, and even if warpage is generated in the housing 1, a load larger than the frictional force can be applied to each contactor 20-2 by pressing each joint portion 27 against each contactor pad 32, thereby moving each contactor 20-1 to a position corresponding to each contactor pad 32. Therefore, alignment can be carried out in accordance with warpage or irregularities of the wiring board 30, and the joint portions 27 are not raised from the contactor pads 32, and the contactor pads 32 can be normally joined to the joint portions 27 by using a solder.

Embodiment 4

Figure 15:
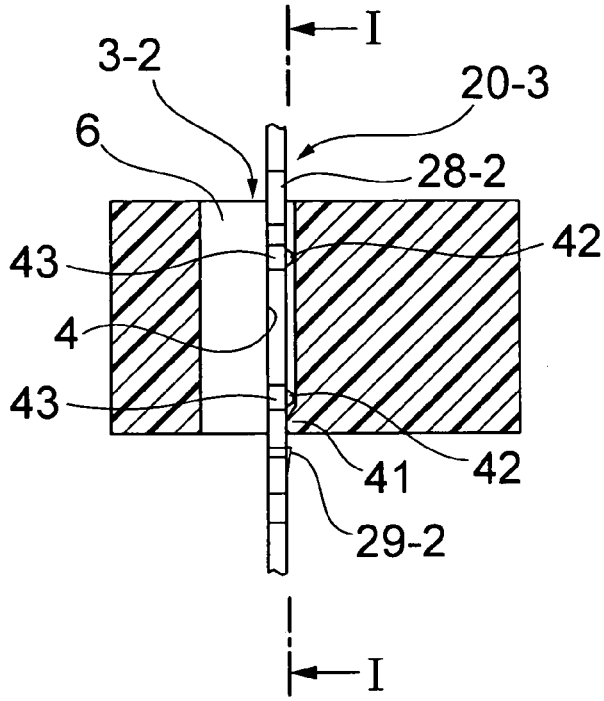
FIG. 15 is an explanatory view showing holding means for each contactor in Embodiment 4 of a surface-mounted electrical connector according to the present invention.
Figure 16:
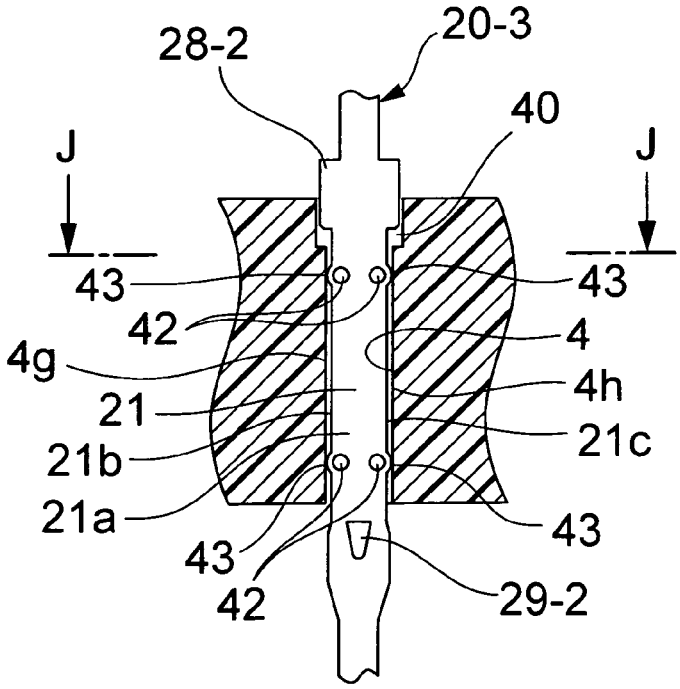
FIG. 16 is a cross-sectional view taken along a line I-I in FIG. 15.
Figure 17:
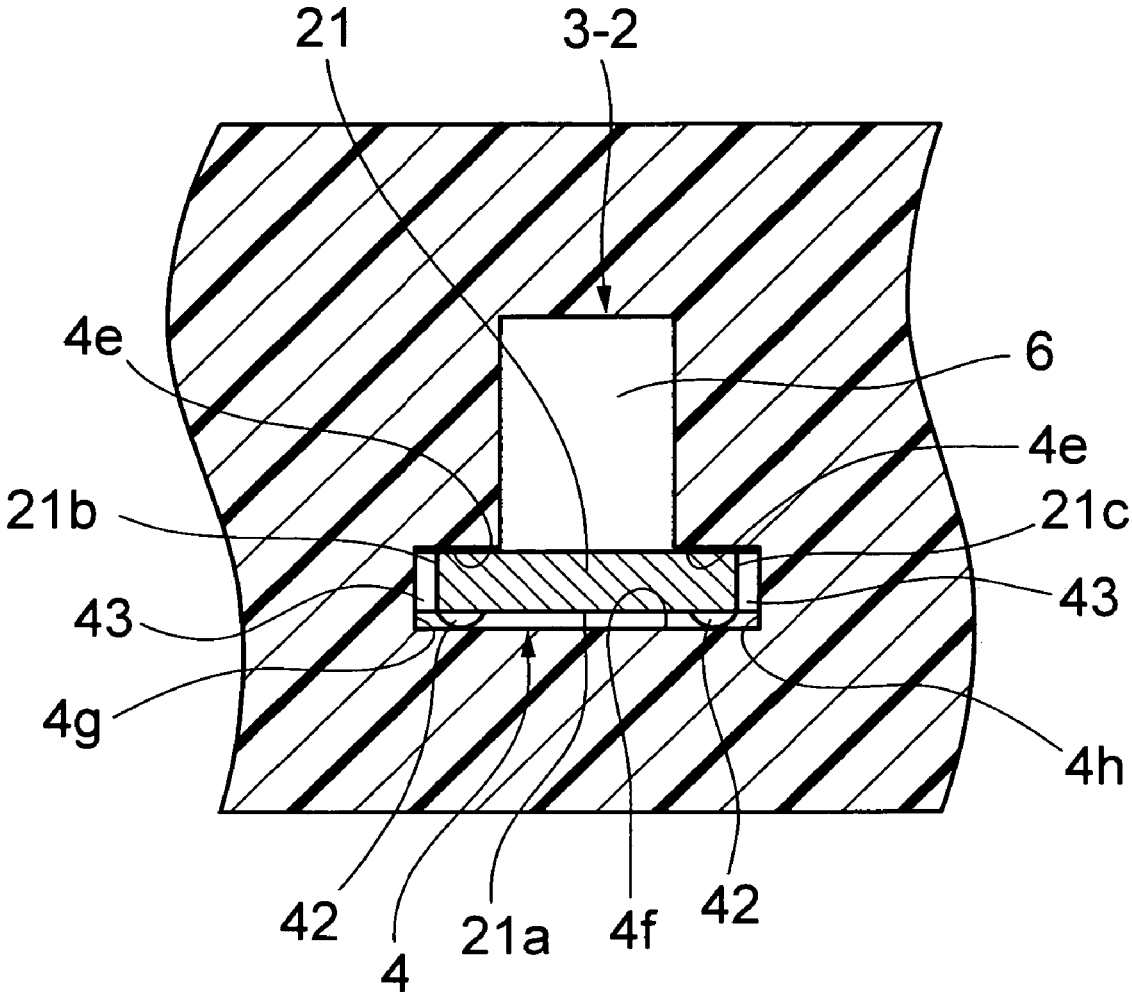
FIG. 17 is a cross-sectional view taken along a line J-J in FIG. 16.

FIGS. 15 to 17 show Embodiment 4 according to the present invention.

A difference of Embodiment 4 according to the present invention from Embodiment 1 of the present invention lies in a shape of a cavity and a contactor which is inserted into this cavity, and other structures are the same as those in Embodiment 1 according to the present invention. Therefore, like reference numerals denote like parts, thereby eliminating their explanation.

As shown in FIG. 17, a cavity 3-2 in Embodiment 4 according to the present invention is constituted of a contactor inserting portion 4 which is positioned in a middle part and has a rectangular shape as seen from a plane, and a hole portion 6 which is positioned in the contactor inserting portion 4 (an upper side in FIG. 17) and through which a joint portion 27 passes and which has a rectangular shape as seen from a plane. A stopper inserting portion 40 is formed at one end part (an upper side in FIG. 16) of the contactor inserting portion 4. Moreover, a protruding portion 41 is formed at a lower part of the contactor inserting portion 4 in FIG. 15.

As shown in FIG. 16, in a contactor 20-3, a pair of left and right contact protruding portions 42 are provided to protrude on a surface portion 21*a* of an inserting portion 21 at upper and lower positions in FIG. 16, and contact protruding portions 43 are provided to protrude on both side surface portions 21*b* and 21*c* of the inserting portion 21 at upper and lower positions in FIG. 16. Additionally, one stopper portion 28-2 is formed on an impact absorbing portion 23 side of the inserting portion 21, and the other protruding stopper portion 29-2 is formed on the surface portion 21*a* of the inserting portion 21 at a lower part in FIG. 16. Further, other structures are the same as those in the contactor 20 in Embodiment 1 according to the present invention.

Further, as shown in FIGS. 15 and 16, the contactor 20-3 is attached in the cavity 3-2 by movably inserting the inserting portion 21 into the contactor inserting portion 4 of the cavity 3-2 and inserting one stopper portion 28-2 into the stopper inserting portion 40.

In this case, as shown in FIG. 17, the contact protruding portions 42 are in contact with an inner wall portion 4*f* of the contactor inserting portion 4, and the contact protruding portions 43 are in contact with the inner wall portions 4*g* and 4*h* on both sides of the contactor inserting portion 4. Bringing the contact protruding portions 42 into contact with the inner wall portion 4*f* presses the inserting portion 21 against the other inner wall portion 4*e* of the contactor inserting portion 4. In this case, the contact protruding portions 42 are brought into contact with the inner wall portion 4*f*, the contact protruding portions 43 are brought into contact with the inner wall portions 4*g* and 4*h*, and the inserting portion 21 is pressed against the other inner wall portion 4*e*, thereby constituting holding means.

Furthermore, the stopper portion 29-2 is positioned outside the contactor inserting portion 4, and an end part of this stopper portion 29-2 is in close proximity to the protruding portion 41 on a back surface 1*b* side of the housing 1. Therefore, a moving range of the contactor 20-3 is a sum of a gap between one stopper portion 28-2 and a bottom surface of the stopper inserting portion 40 and a gap between the end part of the stopper portion 29-2 and the protruding portion 41.

As described above, the contactor 20-3 is held in the housing 1 by a frictional force acting between the contact protruding portions 42 of the inserting portion 21 and the inner wall portion 4*f* of the contactor inserting portion 4, a frictional force acting between the contact protruding portions 43 of the inserting portion 21 and the inner wall portions 4*g* and 4*h* of the contactor inserting portion 4 and a frictional force acting between the inserting portion 21 and the other inner wall portion 4*e* of the contactor inserting portion 4, and applying to the contactor portion 20-3 a load larger than the frictional forces can move the contactor 20-3 in its moving range.

Therefore, a gel type cream solder (not shown) containing a solder component and a flux component is previously attached on each contactor pad 32 of one wiring board 30, and joint portions 27 of many contactors 20 are pressed against the respective contactor pads 32. Then, heating is effected, thereby soldering the joint portions 27 to the contactor pads 32. It is to be noted that, when the contactor 20-3 is largely moved, one stopper portion 28-2 collides with the stopper inserting portion 40 of the housing 1, and the end part of the stopper portion 29-2 collides with the protruding portion 41, thereby preventing the contactor 20-3 from falling off.

As described above, according to Embodiment 4 of the present invention, even if one wiring board 30 has warpage or irregularities and its flatness degree is not smaller than an allowable value, and even if warpage is generated in the housing 1, when the joint portions 27 are pressed against the respective contactor pads 32 to apply to the contactors 20-3 a load larger than the frictional force with respect to the housing, the contactors 20-3 can be moved to a position corresponding to the contactor pads 32. Therefore, alignment can be carried out in accordance with warpage or irregularities of the wiring board 30, the joint portions 27 are not raised from the contactor pads 32, and the contactor pads 32 can be normally jointed to the joint portions 27 by using the solder.

It is to be noted that, in each of Embodiments 1, 2 and 3 according to the present invention mentioned above, the contactor 20, 20-1, 20-1 or 20-3 of the surface-mounted electrical connector A is configured to have the joint portion 27 which is solder-jointed to each contactor pad 32 of one wiring board 30 at one end portion, and the connecting portion 24 which is dip-soldered in each through hole 35 of the other wiring board 33 at the other end portion. However, the contactor may be configured to have a joint portion which is solder-jointed to each contactor pad of one wiring board at one end portion, and a connecting portion which is in contact with each contactor of the opposite electrical connector at the other end portion, and the connecting portion of this contactor may be connected with the contactor of the opposite electrical connector in a state where the joint portion is jointed to each contactor pad of one wiring board.

According to the surface-mounted electrical connector of the present invention, even if the wiring board has warpage or irregularities and its flatness degree is not smaller than an allowable value, and even if warpage is generated in the housing, a load larger than a holding force can be applied to each contactor by pressing each joint portion against each contactor pad, thereby moving the contactor to a position corresponding to each contactor pad. Therefore, there is provided an effect that the joint portion is not raised from the contactor pad and the contactor pad can be normally jointed to the joint portion by using the solder, and hence the present invention is useful to an electrical connector which connects two wiring boards with each other.

What is claimed is:

1. A surface-mounted electrical connector for connecting a first wiring board having a contactor pad and a second wiring board having a through hole, comprising:

a contactor including a joint portion at one end portion thereof to be connected to the contactor pad; and a housing for holding the contactor with a holding force such that the contactor moves along an axial line thereof with respect to the housing when a load greater than the holding force is applied to the contactor, wherein said housing includes a cavity for inserting the contactor; said contactor further includes a connecting portion at the other end portion thereof to be inserted into the through hole; and said contactor is arranged such that the joint portion is pressed against the contactor pad to move the contactor to a position corresponding to the contactor pad only when the load greater than the holding force is applied to the contactor along the axial line.

2. The surface-mounted electrical connector according to claim 1, wherein said housing includes a housing main body having a U-character shape in a plane view and a reinforcing bar portion connecting opposed intermediate portions of the housing main body.

3. The surface-mounted electrical connector according to claim 1, wherein said housing includes a spacer for maintaining a predetermined gap between the first wiring board and the second wiring board.

4. The surface-mounted electrical connector according to claim 1, wherein said contactor further includes a retaining member for preventing the contactor from falling off from the housing.

5. The surface-mounted electrical connector according to claim 4, wherein said retaining member includes a first stopper portion for preventing the contactor from falling off in one direction along the axial line and a second stopper portion for preventing the contactor from falling off in another direction along the axial line.

6. The surface-mounted electrical connector according to claim 1, further comprising a holding member for holding the contactor.

7. The surface-mounted electrical connector according to claim 6, wherein said holding member includes a spring piece portion disposed inside a cavity formed in the housing such that the spring piece portion contacts with the contactor in a compressed state when the contactor is inserted into the cavity.

8. The surface-mounted electrical connector according to claim 6, wherein said holding member includes a spring piece portion disposed on an inserting portion of the contactor to be inserted into a cavity formed in the housing such that the spring piece portion contacts with an inner wall portion of the cavity in a compressed state to press the inserting portion against the inner wall portion when the inserting portion is inserted into the cavity.

9. The surface-mounted electrical connector according to claim 6, wherein said holding member includes a contact protruding portion disposed on an inserting portion of the contactor to be inserted into a cavity formed in the housing such that the contact protruding portion contacts with an inner wall portion of the cavity to press the inserting portion against the inner wall portion when the inserting portion is inserted into the cavity.

10. The surface-mounted electrical connector according to claim 6, wherein said holding member includes a contact protruding portion disposed inside a cavity formed in the housing such that the contact protruding portion contacts with the contactor when the contactor is inserted into the cavity.

11. A surface-mounted electrical connector for connecting a first wiring board having a contactor pad and a second wiring board having a through hole, comprising:

a contactor including a joint portion at one end portion thereof to be connected to the contactor pad; and a housing for holding the contactor with a holding force such that the contactor moves along an axial line thereof with respect to the housing when a load greater than the holding force is applied to the contactor, wherein said housing includes a housing main body having a U-character shape in a plane view and a reinforcing bar portion connecting opposed intermediate portions of the housing main body.

12. A surface-mounted electrical connector for connecting a first wiring board having a contactor pad and a second wiring board having a through hole, comprising:

a contactor including a joint portion at one end portion thereof to be connected to the contactor pad; and a housing for holding the contactor with a holding force such that the contactor moves along an axial line thereof with respect to the housing when a load greater than the holding force is applied to the contactor, wherein said housing includes a spacer for maintaining a predetermined gap between the first wiring board and the second wiring board.

13. A surface-mounted electrical connector for connecting a first wiring board having a contactor pad and a second wiring board having a through hole, comprising:

a contactor including a joint portion at one end portion thereof to be connected to the contactor pad; and a housing for holding the contactor with a holding force such that the contactor moves along an axial line thereof with respect to the housing when a load greater than the holding force is applied to the contactor, and a holding member for holding the contactor, wherein said holding member includes a spring piece portion disposed on an inserting portion of the contactor to be inserted into a cavity formed in the housing such that the spring piece portion contacts with an inner wall portion of the cavity in a compressed state to press the inserting portion against the inner wall portion when the inserting portion is inserted into the cavity.

14. A surface-mounted electrical connector for connecting a first wiring board having a contactor pad and a second wiring board having a through hole, comprising:

a contactor including a joint portion at one end portion thereof to be connected to the contactor pad;

a housing for holding the contactor with a holding force such that the contactor moves along an axial line thereof with respect to the housing when a load greater than the holding force is applied to the contactor, and a holding member for holding the contactor, wherein said holding member includes a contact protruding portion disposed on an inserting portion of the contactor to be inserted into a cavity formed in the housing such that the contact protruding portion contacts with an inner wall portion of the cavity to press the inserting portion against the inner wall portion when the inserting portion is inserted into the cavity.

15. A surface-mounted electrical connector for connecting a first wiring board having a contactor pad and a second wiring board having a through hole, comprising:

a contactor including a joint portion at one end portion thereof to be connected to the contactor pad;

a housing for holding the contactor with a holding force such that the contactor moves along an axial line thereof with respect to the housing when a load greater than the holding force is applied to the contactor, and a holding member for holding the contactor, wherein said holding member includes a contact protruding portion disposed inside a cavity formed in the housing such that the contact protruding portion contacts with the contactor when the contactor is inserted into the cavity.

* * * * *